US005896144A

United States Patent [19]

Kishimoto et al.

[11] Patent Number: 5,896,144

[45] Date of Patent: Apr. 20, 1999

[54] INK JET RECORDING APPARATUS HAVING UNITARY CAP WITH WIPER PORTION FORMED THEREWITH

[75] Inventors: Mitsuru Kishimoto; Noboru Ooishi; Masahiko Shimosugi; Shigenori Koido, all of Tokyo, Japan

[73] Assignee: Oki Data Corporation, Tokyo, Japan

[21] Appl. No.: 08/701,545

[22] Filed: Aug. 26, 1996

[30] Foreign Application Priority Data

Aug. 29, 1995 [JP] Japan ..... 7-220562

[51] Int. Cl.[6] ..... B41J 2/165

[52] U.S. Cl. ..... 347/30; 347/33

[58] Field of Search ..... 347/29, 30, 31, 347/32, 33, 23, 36, 24, 44

[56] References Cited

U.S. PATENT DOCUMENTS

| | | | |
|---|---|---|---|
| 5,103,244 | 4/1992 | Gast et al. | 347/33 |
| 5,583,547 | 12/1996 | Gast et al. | 347/22 |
| 5,625,385 | 4/1997 | Suzuki | 347/24 |
| 5,670,997 | 9/1997 | Sugimoto et al. | 347/30 |

FOREIGN PATENT DOCUMENTS

| | | | |
|---|---|---|---|
| 452119 | 10/1991 | European Pat. Off. | 347/30 |
| 62-111751 | 5/1987 | Japan | 347/33 |
| 1-264853 | 10/1989 | Japan | 347/24 |
| 2-106353 | 4/1990 | Japan | 347/44 |
| 6135004 | 5/1994 | Japan | 347/33 |
| 6-255114 | 9/1994 | Japan | 347/29 |

*Primary Examiner*—N. Le
*Assistant Examiner*—Thien Tran
*Attorney, Agent, or Firm*—Rabin & Champagne, P.C.

[57] ABSTRACT

An ink jet recording apparatus is of the construction where information is printed by ejecting ink drops through orifices of an ink jet head mounted on a carriage. The ink jet recording apparatus includes a cap for closing the surface of the ink jet head in which the orifices are formed. The cap is adapted to move between a first position at which the cap is fully disengaged with the orifices, and a second position at which the cap is engaged with the orifices. The cap communicates with a suction mechanism which negatively pressurizes the cap when the cap is at the second position. The carriage, cap, and suction mechanism are controllably driven by a controller. The cap is provided with an engagement member, which may take the form of a sweep blade, attached to its tip for sweeping the surface in which the orifices are formed. The controller causes the carriage to move when the engagement member moves to the second position so that the engagement member sweeps the surface to remove denatured ink and foreign matters from the orifices into the cap.

16 Claims, 12 Drawing Sheets

INK JET RECORDING APPARATUS HAVING UNITARY CAP WITH WIPER PORTION FORMED THEREWITH

BACKGROUND OF THE INVENTION

The present invention relates to an ink jet recording apparatus.

With conventional ink jet recording apparatuses such as a serial dot printer, one method of ejecting ink uses a heater provided in an ink pressure chamber which generates bubbles to eject ink drops, and another method uses a piezoelectric element which generates a pressure in an ink pressure chamber to eject ink drops. Such an ink jet apparatus is disadvantageous in that foreign matter, and air often enter the holes (referred to as orifice hereinafter) in the tip of the ink jet head (referred to as head hereinafter) through which ink drops are ejected, and the ink is apt to dry around the orifices. The foreign matter and air bubbles trapped in the orifices, and dried ink are causes of improper ejection of ink drops. Therefore, this type of conventional apparatus has a cap, ink-receiving dish, and sweep blade which are provided independently of each other. The cap covers the orifices when printing is not taking place, in order to prevent the ink from drying. The ink-receiving dish covers the orifices when suction of is applied to the orifices and unprinted ink drops are ejected so as to withdraw the foreign matter, denatured (dried) ink, and air bubbles in and around the surfaces. The sweep blade sweeps the orifice surface when cleaning the orifice surface.

However, having a cap, ink-receiving dish, and sweep blade which are independent of each other is not desirable since each of these structural elements needs a drive mechanism and some space in the ink jet recording apparatus.

SUMMARY OF THE INVENTION

An object of the invention is to provide an ink jet recording apparatus which requires a minimum of space for accommodating various mechanisms. An ink jet recording apparatus according to the invention is of the construction where information is printed by ejecting ink drops through orifices of an ink jet head mounted on a carriage. The ink jet recording apparatus includes a cap for closing the orifice surface of the ink jet head in which the orifices are formed. The cap is adapted to move between a first position (disengagement position) at which the cap is fully away from the orifices and a second position (engagement position) at which the cap closes the orifices. The cap communicates with a suction mechanism which negatively pressurizes the cap when the cap is at the second position. The carriage, cap, and suction mechanism are controllably driven by a controller. The cap is provided with an engagement member attached to its tip. When the cap moves to the second position, the controller causes the carriage to move so that the engagement member sweeps the surface to remove denatured ink and foreign matter from the orifices into the cap. The cap may also be adapted to tilt with respect to the surface of the head, so that the controller causes the carriage to move in parallel with the orifice surface when the cap moves to a third position at which part of the engagement member is in contact with the orifice surface, whereby this part of the engagement member sweeps the orifice surface to remove the denatured ink and foreign matter from the orifices into the cap. The engagement member may take the form of a sweep blade which may be provided in the cap so that the tip of the sweep blade is in contact with the orifices when the cap moves to the third position, whereby the tip of the sweep blade sweeps the orifice surface. The sweep blade and the cap may be made of a resilient material such as rubber and may be formed in one piece construction with the cap.

DETAILED DESCRIPTION OF THE INVENTION

Preferred embodiments of the invention will be described in detail with reference to the drawings.

First embodiment

Figure 1:
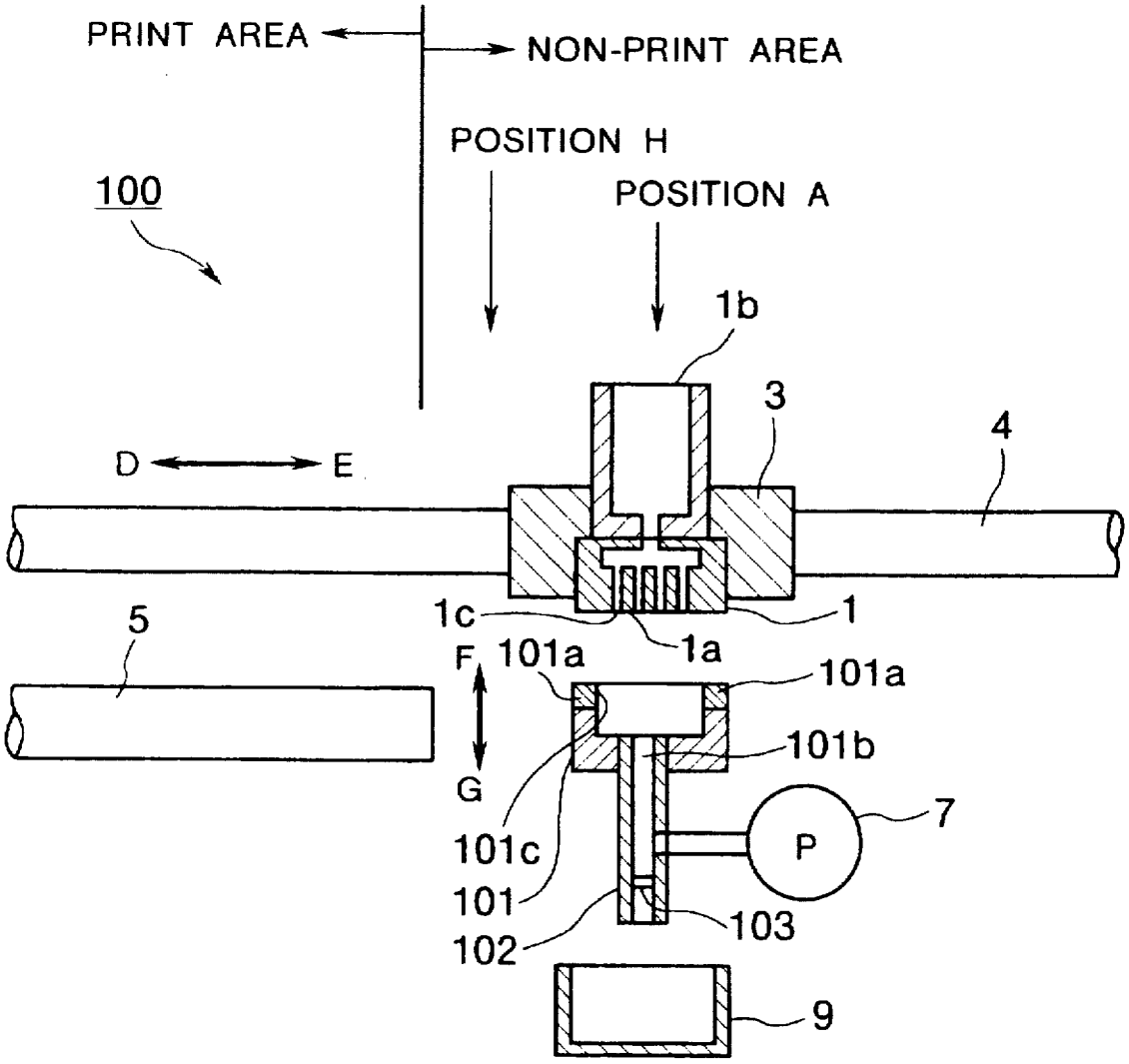
FIG. 1 illustrates a general construction of a first embodiment.

FIG. 1 is a partially cross-sectional view illustrating a first embodiment.

Referring to FIG. 1, an ink jet recording apparatus 100 includes a head 1, ink cartridge **1*b*, carriage 3 on which the head 1 and ink cartridge 1*b* are carried, and platen 5. The head 1 has an orifice surface 1*a* in which orifices 1*c* are formed and ink drops are ejected through the orifices 1*c* during printing operation. During printing operation, the carriage 3 is adapted to move in directions shown by arrows D and E along a carriage shaft 4. The carriage 3 moves in the direction shown by arrow E to a non-print area for capping operation and cleaning operation. The term "cleaning operation" is used in this specification to cover dummy ejection of ink from the orifices 1*c*, suction of denatured ink and foreign matters from the orifices 1*c*, and sweeping of the orifice surface 1*a*, which are described later. The platen 5 extends in parallel to the carriage shaft 4 and supports a print medium, not shown, thereon. Disposed in the non-print area of the ink jet recording apparatus 100 is a cap 101 which receives ink drops during later described dummy ejection and closes the downward facing rectangular orifice surface 1*a* parallel with the carriage shaft 4 during suction. The dummy ejection and suction are performed when not printing. The cap 101 is positioned under the orifice surface 1***a*, has an upward opening, and is formed with a hole 101*b* in its bottom, through which the cap 101 communicates with a pipe 102. The pipe 102 extends between the cap 101 and an ink basin 9, and communicates with a suction mechanism 7 that creates a negative pressure in the cap 101.

The cap 101 is adapted to move normal to the surface 1*a*, upward and downward, i.e., in directions shown by arrows F and G. The cap 101 moves fully in the direction shown by arrow F to an engagement position to close the orifices 1*c* of the head 1, and fully in the direction shown by arrow G to a disengagement position to expose the orifices 1*c*.

The carriage 3 is adapted to move along the shaft 4 in the print area during printing operation. The carriage 3 is adapted to move along the shaft 4 and to stop at positions A and H in the non-print area for cleaning operation. Position A is a position at which the orifice surface 1*a* of the head 1 directly faces the cap 101 during capping and suction operations and dummy ejection of ink. Position H is a position to which the carriage 3 moves in the direction shown by arrow D during sweeping operation so that the orifice surface 1*a* is fully swept by the engagement member 101*a*.

The cap 101 is provided with an engagement member 101*a* on its tip. The engagement member 101*a* is formed of a resilient material such as rubber. The engagement member 101*a* contacts the orifice surface 1*a* of the head 1 and sweeps the orifice surface 1*a* during sweeping operation.

The pipe 102 has a solenoid valve 103 incorporated therein which is driven by a solenoid, not shown, to open and close the pipe 102. The solenoid is energized at the same time that the suction mechanism 7 is energized, opening the solenoid valve 103 to communicate the space inside the cap 101 with the atmosphere. The solenoid is deenergized at the same time that the suction mechanism 7 is deenergized, closing the solenoid valve 103, thereby preventing the ink from drying due to air entering the pipe 102. An ink basin 9 opposes the free end of the pipe 102. In addition to the cap 101, an additional cap similar to a cap 11 as shown in FIG. 11B, exclusively used for capping operation may be provided in the non-print area.

Figure 2:
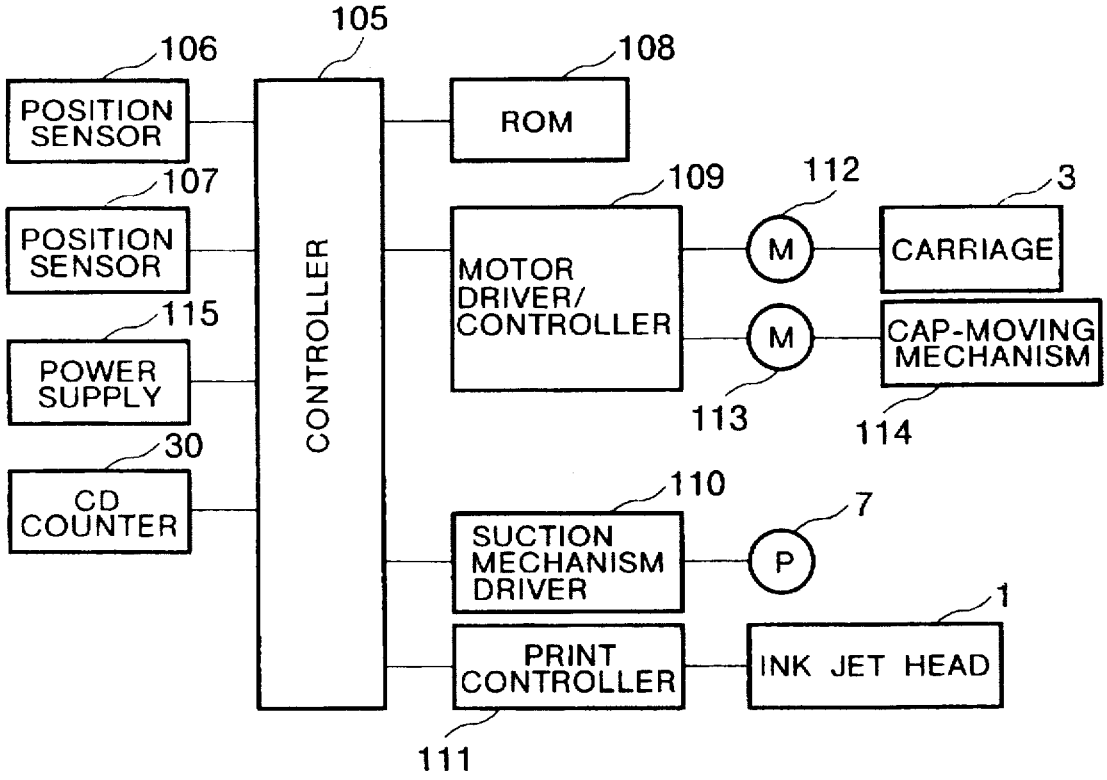
FIG. 2 illustrates a control system of the first embodiment.

FIG. 2 is a block diagram illustrating the control system of the first embodiment. The control system of the first embodiment will now be described with reference to FIG. 2.

The controller 105 controls the entire operation of the ink jet recording apparatus 100 in accordance with program data stored in a ROM 108. In addition to the program data, the ROM 108 stores a plurality of items of data such as a predetermined number N of "dummy ejections" (referred to as DE data), a predetermined cumulative number of dots (referred to as CD data) printed by the head 1, and a predetermined duration of suction (referred to as DS data hereinafter), which are described later in more detail. The controller 105 is connected with position sensors 106 and 107, power supply 115, motor driver/controller 109, suction mechanism driver 110, CD counter 30, and print controller 111. The CD counter may be incorporated in the controller 105. The position sensor 106 detects the positions of the carriage 3 in the directions shown by arrows D and E, and the position sensor 107 detects the positions of the cap 101 in the directions shown by arrows F and G.

The motor driver/controller 109 is connected to motors 112 and 113. The motor 112 drives the carriage 3 and the motor 113 drives the cap moving mechanism 114 that holds and carries the cap 101 thereon. The CD counter 30 counts the cumulative number of dots printed by the head 1. The CD counter 30 is preferably formed of an EEPROM, so that when the power supply to the ink jet recording apparatus 100 is turned off, the CD counter 30 holds its content, and when the ink jet recording apparatus 100 is turned on again, the CD counter 30 starts counting again from where it stopped counting last time. The suction mechanism driver 110 is connected to the suction mechanism 7 and the print controller 111 is connected to the head 1.

Figure 3:
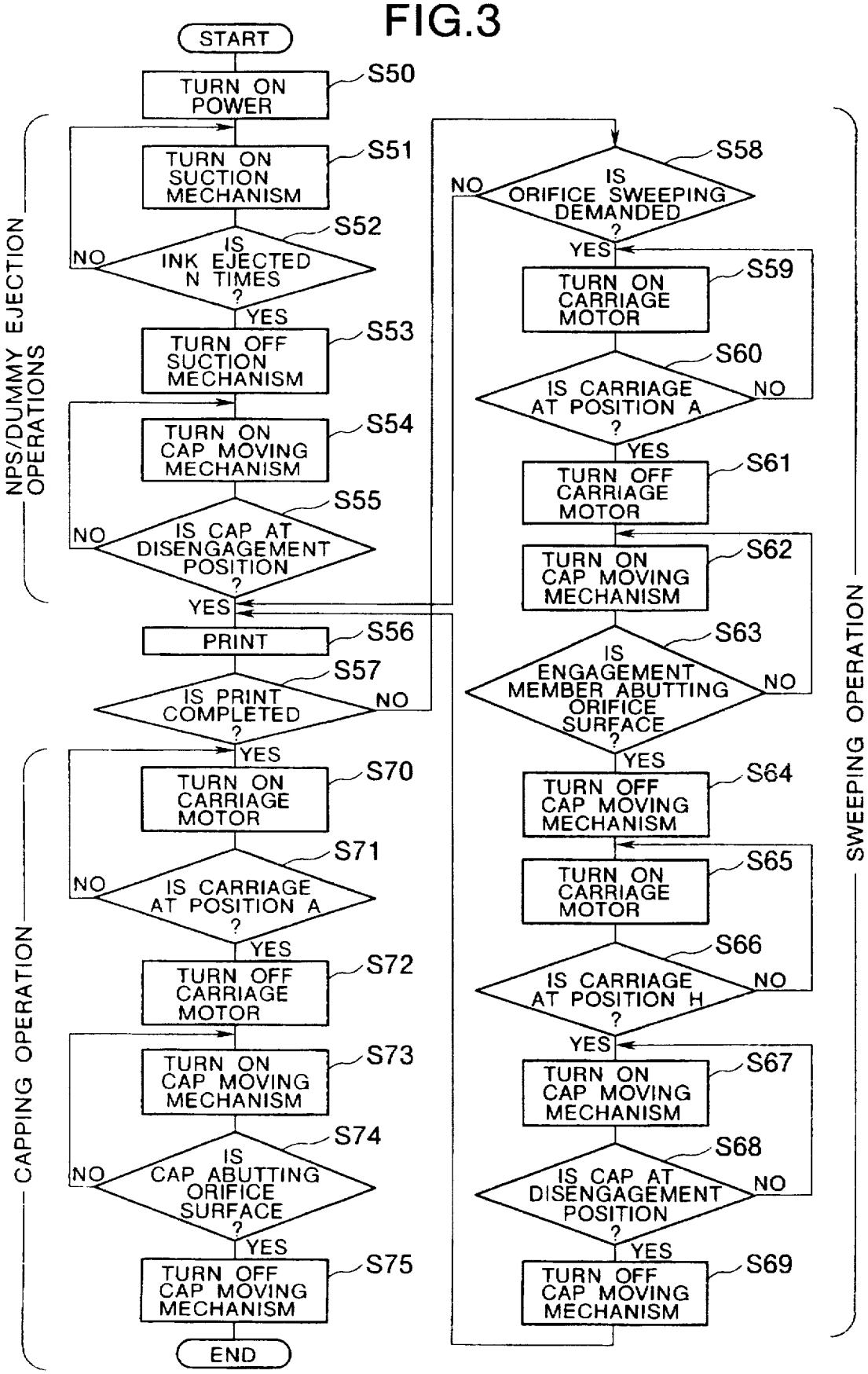
FIG. 3 is a flowchart illustrating the operation of the first embodiment.
Figure 4:
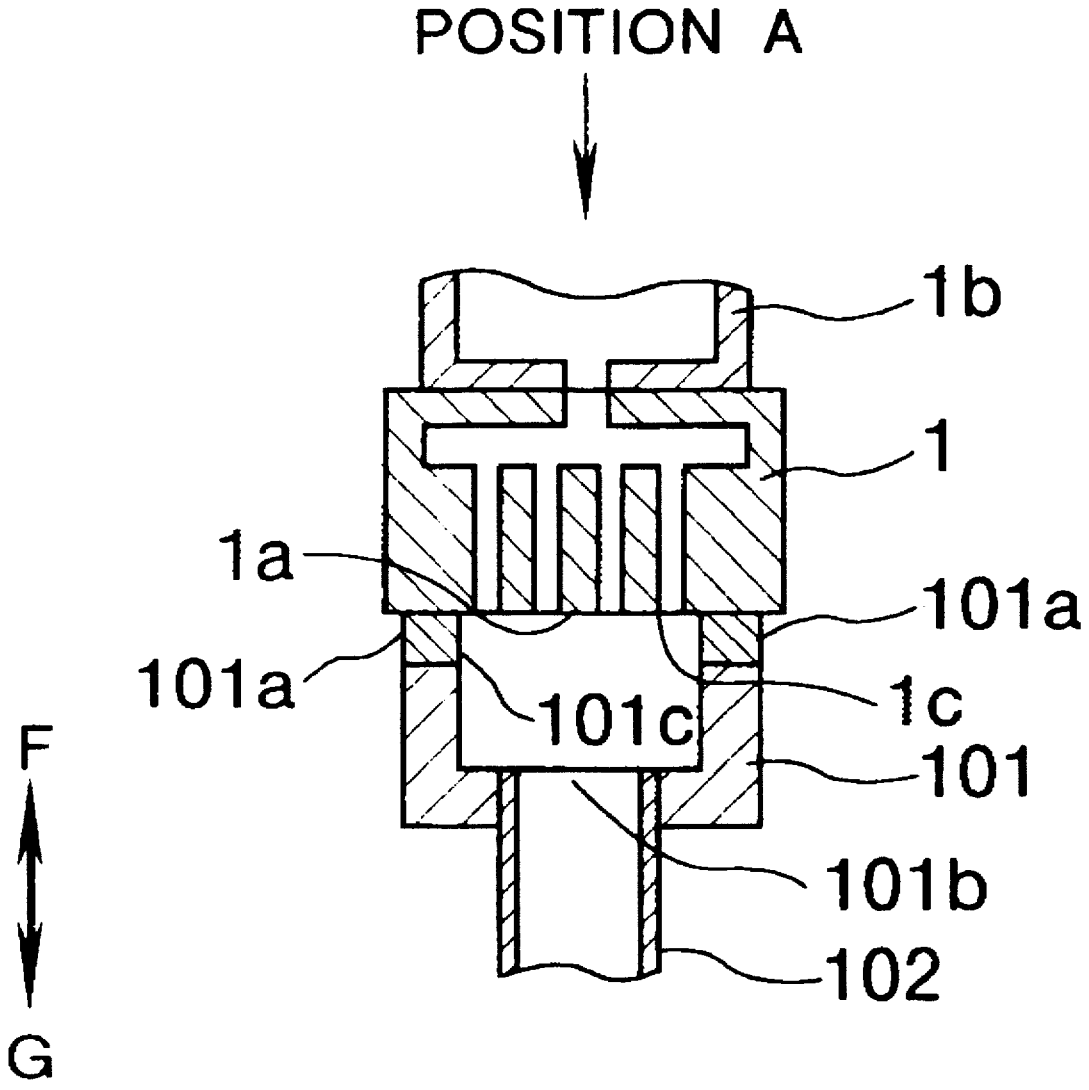
FIG. 4 is a cross-sectional view of the first embodiment showing a print head as being capped.
Figure 5A:
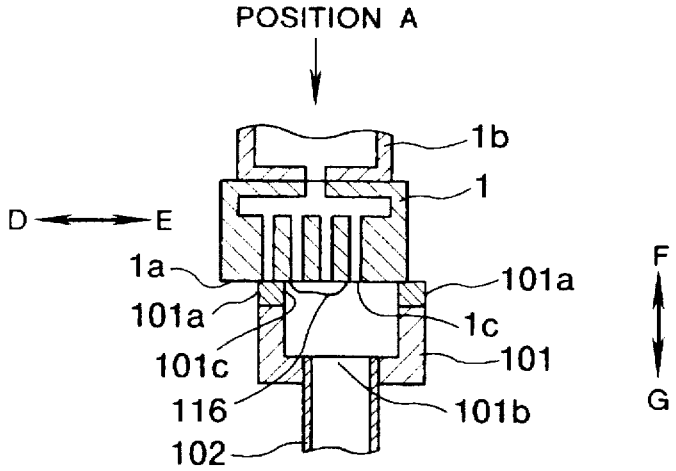
FIGS. 5A–5C illustrate the cleaning operation of the first embodiment.
Figure 5B:
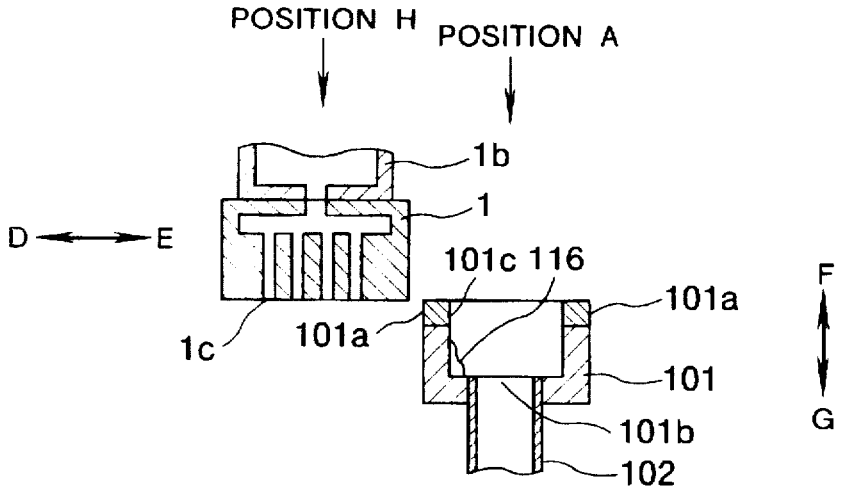
Figure 5C:
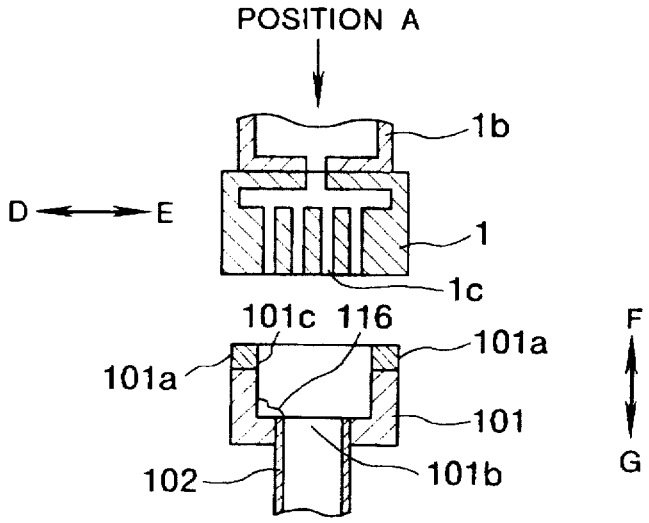

The cleaning sequence of the ink jet recording apparatus 100 varies depending on the characteristics of the head 1 and the ink. FIG. 3 is a flowchart illustrating one example of the operation of the first embodiment. FIG. 4 is a cross-sectional view of the head 1 and the cap 101 when the head 1 is capped by the cap 101, and FIGS. 5A–5C illustrate the cleaning operation of the ink jet recording apparatus 100 according to the first embodiment.

An example of the cleaning operation of the first embodiment will now be described with reference to FIGS. 1–4 and FIGS. 5A–5C.

As shown in FIG. 4, the carriage 3 is at position A and the cap 101 closes the orifice surface 1*a* of the head 1 when the power supply 115 is turned off. When the power supply 13 is turned on at step S50 in FIG. 3, a power-on signal is sent to the controller 105. Then, in response to the power-on signal, the program proceeds to step S51 where the controller 105 causes the suction mechanism driver 110 to controllably drive the suction mechanism 7 while also opening the solenoid valve 103. Thus, the cap 101 is negatively pressurized so that denatured ink and air bubbles trapped in the ink are sucked from the orifices 1*c* of the head 1 and are directed through the hole 101*b* into the pipe 102 to the ink basin 9. At this time, the controller 105 outputs a signal in response to which the print controller 111 causes the orifices 1*c* to eject ink drops the predetermined number N of times, i.e., until the DE data stored in the ROM 108 is reached. The controller 105 times an elapsed time from when the suction mechanism driver 110 starts to drive the suction mechanism 7, and compares the elapsed time with the DS (duration of suction) data stored in the ROM 108. When the elapsed time exceeds the DS data, the program proceeds to step S53 where the controller 105 outputs a stop signal to the suction mechanism driver 110 to stop the suction mechanism 7. Simultaneously, the controller 105 causes the solenoid valve 103 to close.

At step S54, the controller 105 causes the motor driver/controller 109 to drive the motor 113 which in turn drives the cap moving mechanism 114 to move the cap 101 in the direction shown by arrow G. At step S55, upon receiving from the position sensor 107 a detection signal indicating that the cap 101 is at the disengagement position shown in FIG. 1, the controller 105 outputs a stop signal to the motor driver/controller 109 in order to stop the motor 113. Thereafter, the controller 105 causes the motor driver/controller 109 to drive the motor 112 so as to move the carriage 3 in the direction shown by arrow D to the print area shown in FIG. 1. At step S56, the controllers 105 and 111 starts to print the data received from a device, not shown.

During printing operation, if the sweeping of the orifice surface 1*a* is demanded at step S58, i.e., when the cumulative number of printed dots exceeds the CD data stored in the ROM 108, the program proceeds to step S59 where the controller 105 outputs a control signal to the motor driver/controller 109, which in turn drives the motor 112 in response to the control signal from the controller 105. Thus, the motor 112 drives the carriage 3 to move in the direction shown by arrow E from the print area to the non-print area shown in FIG. 1. Upon receiving from the position sensor 106 a detection signal indicating that the carriage 3 is at position A at step S60, the controller 105 outputs a stop signal to the motor driver/controller 109 at step S61 in order to stop the motor 112. Thereafter, the controller 105 causes the motor driver/controller 109 to drive the motor 113 so as to move the cap 101 in the direction shown by arrow F. Upon receiving at step S63 from the position sensor 107 a detection signal indicating that the engagement member 101*a* abuts the orifice surface 1*a*, the program proceeds to step S64 where the controller 105 outputs a stop signal to the motor driver/controller 109 in order to stop the motor 113.

At step S65, the controller 105 again causes the motor driver/controller 109 to drive the motor 112 so as to move the carriage 3 in the direction shown by arrow D as shown in FIG. 5A. Ink 116 and foreign matter adhering to the orifice surface 1*a* are wiped off the orifice surface 1*a* by the tip of the inner surface 101*c* of the engagement member 101*a* as the carriage 3 moves in the direction shown by arrow D, and drops into the cap 101. As shown in FIG. 5B, after the carriage 3 has been moved to position H where the tip of the inner surface 101*c* completes sweeping of the orifice surface 1*a*, the controller 105 stops the movement of the carriage 3. The program proceeds to step S67 where the controller 105 causes the motor driver/controller 109 to drive the motor 113, so that the cap 101 is moved in the direction shown by arrow G as shown in FIG. 5C. At step S68, upon receiving from the position sensor 107 a detection signal indicating that the cap 101 has taken up the disengagement position, the program proceeds to step S69 where the controller 105 outputs a stop signal to the motor driver/controller 109 in order to stop the motor 113.

Performing step S69 completes the sweeping operation of the orifice surface 1*a*. Then, the program jumps back to step S56 where printing operation is resumed. Whenever the orifice sweeping operation is called for, even during printing operation, the aforementioned steps S59–S69 are carried out. Upon completion of printing operation (step S57), the program proceeds to step S70 where capping operation is performed.

In the capping operation, the controller 105 causes the carriage 3 to move in the direction shown by arrow E from the print area to the non-print area until the controller 105 receives at step S71 from the position sensor 106 a detection signal indicating that the carriage 3 has taken up position A. Then, the controller 105 causes the motor 113 to move the cap 101 in the direction shown by arrow F at step S73, and stops the motor 113 at step S75 upon receiving at step S74 from the position sensor 107 a detection signal indicating that the engagement member 101*a* abuts the orifice surface 1*a*. Performing step S75 completes capping operation, closing the orifice surface 1*a* of the head 1.

The first embodiment includes the solenoid valve 103 adapted to close the pipe 102 so that the orifice surface 1*a* is completely closed when the cap 101 abuts the head 1. The solenoid valve 103 may be eliminated as far as the closing of the orifice surface 1*a* is ensured during capping operation of the orifice surface 1*a* and the opening of the pipe 102 is ensured during suction.

The engagement member 101*a* serves as a seal and a sweep blade, eliminating the need for providing a cap and a sweep blade separate from the cap. Thus, providing the engagement member 101*a* reduces the cost of the ink jet recording apparatus. The foreign matter and ink removed from the orifice surface 1*a* by the engagement member 101*a* are first received into the cap 101 and then directed through the pipe 102 into the ink basin 9 by suction. This eliminates the possibility of removed ink and foreign matter soiling the outer walls of the cap 101 and interior of the recording apparatus, thereby ensuring reliability of the apparatus.

Some ink jet recording apparatuses incorporate a cap for receiving unprinted ink drops ejected from the head 1 and another cap used for capping the orifices. Such a conventional construction necessitates that each cap has, independently of the other, a cap moving mechanism for moving the cap, pipe for directing the ink drops during dummy ejection and suction, and ink basin for storing ink drops coming from the pipe. Providing individual moving mechanisms, pipes and ink basins is undesirable because the configuration of the recording apparatus is complex. In the first embodiment, the cap 101 receives ink drops during both dummy ejection and suction and caps the orifices, eliminating a need for individually providing the moving mechanisms, pipes and ink basins and therefore simplifying the structure of the apparatus.

The bottom surface of the cap 101 may be formed to extend downwardly toward the hole 101*b*, so that the ink dropped onto the bottom of the cap 101 easily flows into the pipe 102 during dummy ejection and suction.

The embodiment is also applicable to a color ink jet recording apparatus which uses a plurality of heads.

Figure 6:
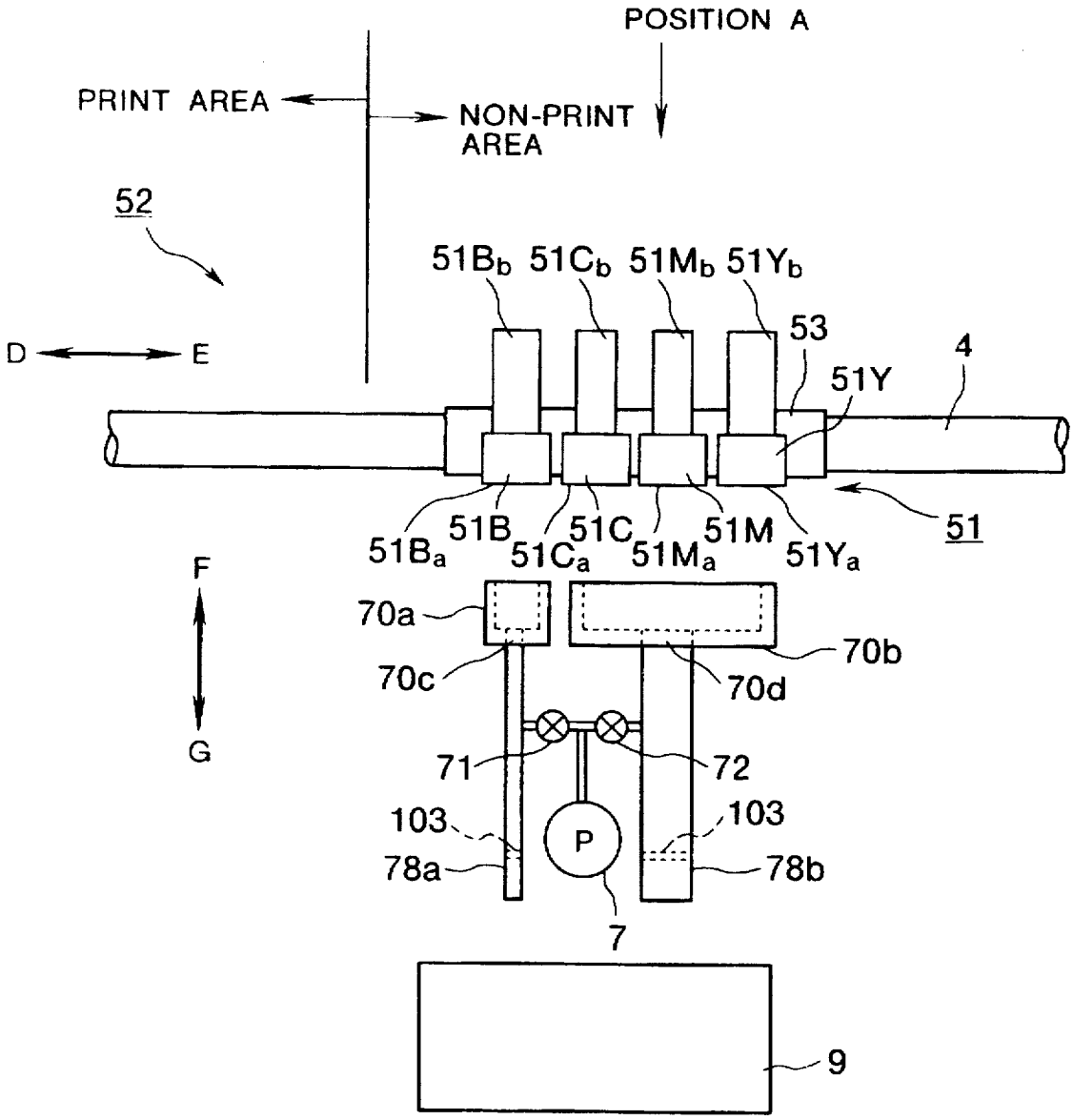
FIG. 6 illustrates a general construction of a color ink jet printer to which the present invention is applicable.

Referring to FIG. 6, a color ink jet recording apparatus 52 has heads 51B, 51C, 51M, and 51Y which are filled with black, cyan, magenta, and yellow inks, respectively. The respective colors are printed in order on a print medium, not shown. The heads 51B, 51C, 51M, and 51Y have ink cartridges 51B*b*, 51C*b*, 51M*b*, and 51Y*b*, respectively, mounted thereto.

Caps 70*a* and 70*b* are disposed in the non-print area of the color ink jet recording apparatus 52. The caps 70*a* and 70*b* are adapted to move in directions shown by arrows F and G. The cap 70*a* moves in the direction shown by arrow F to close the orifice surface 51B*a* when the carriage 53 is at position A. The cap 70*a* has a hole 70*c* in its bottom through which the cap 70*a* communicates with a pipe 78*a*. The cap 70*b* moves in the direction shown by arrow F to close the orifice surfaces 51C*a*, 51M*a*, and 51Y*a* of the heads 51C, 51M, and 51Y, respectively, when the carriage 53 is at position A. The cap 70*b* is formed with a hole 70*d* in its bottom through which the cap 70*b* communicates with a pipe 78*b*. The pipes 78*a* and 78*b* are connected via valve mechanisms 71 and 72 to a suction mechanism 7 so that the caps 70*a* and 70*b* are selectively communicated with and negatively pressurized by the suction mechanism 7. Just as in the construction shown in FIG. 1, the pipes 78*a* and 78*b* are also provided with solenoid valves 103. The valves 103 is closed when capping operation is performed so as to prevent the ink from drying due to the air entering the pipe 102. The caps 70*a* and 70*b* may also be provided with engagement members as shown in FIG. 1. In addition to the caps 70*a* and 70*b*, additional caps similar to a cap 11 as shown in FIG. 11B, exclusively used for capping operation may be provided in the non-print area.

Second embodiment

Figure 7:
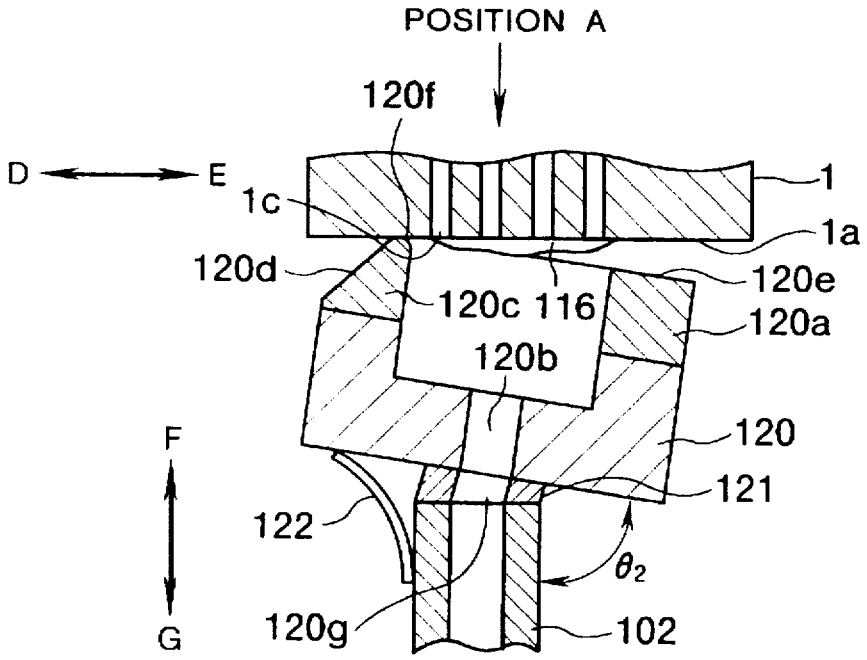
FIGS. 7 and 8 are enlarged views of a cap of a second embodiment.
Figure 8:
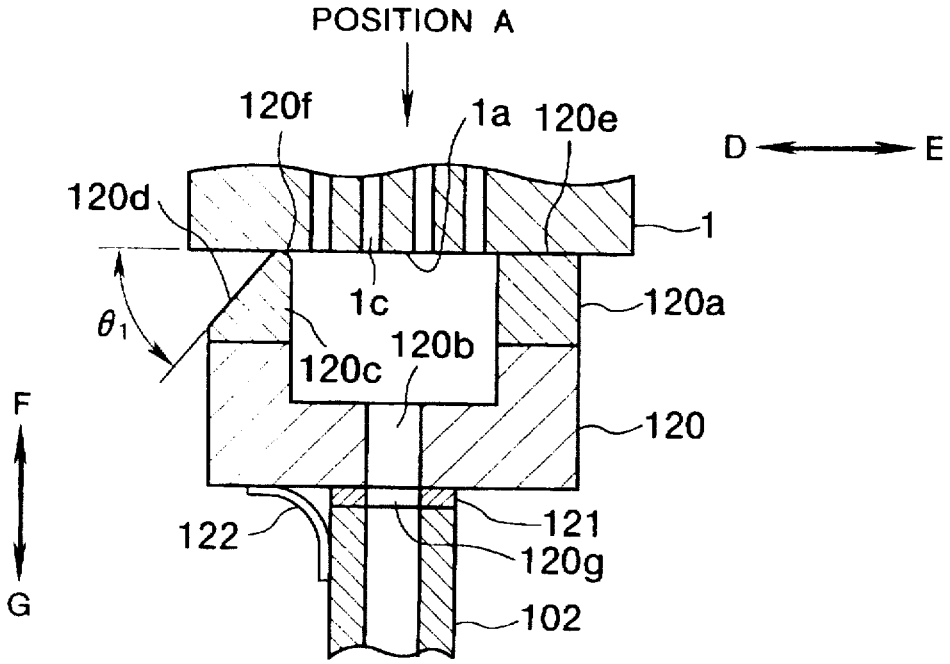

FIGS. 7 and 8 are cross-sectional views illustrating a cap according to a second embodiment. In the second embodiment, the cap is adapted to tilt with respect to the orifice surface. The second embodiment will be described with reference to FIGS. 7 and 8.

The cap 120 is provided with walls 120*c* and 120*a* and further walls, not shown, connecting the walls 120*c* and 120*a* which are formed of the same material as the engagement member 101*a* of the first embodiment. These walls define an engagement member, generally rectangular as seen from above. Just as in the first embodiment, the wall 120*c* contacts the orifice surface 1*a* of the head 1 to sweep the orifice surface 1*a*. Referring to FIG. 7, the wall 120*c* has an inclined outer surface 120*d* so that the wall 120*c* is of a tapered shape. The cap 120 is formed with a hole 120*b* through which the cap 120 communicates with a pipe 102. Between the cap 120 and the pipe 102 is interposed a resilient member 121 which is compressively deformable when a compressive force is applied. The resilient member 121 has a hole 120*g* having the same diameter as the pipe 102. The resilient member 121 resiliently supports the cap 120 so that the cap 120 can tilt with respect to the orifice surface 1*a*. A flat spring 122 is secured at its one end to the pipe 102 and at its other end to the outer bottom surface of the cap 120.

The spring 122 urges the cap 120 upwardly so that the resilient member 121 is compressively deformed causing the cap 120 to tilt at an angle $\theta_2$ with the pipe 102 as shown in FIG. 7. When the cap 120 is moved toward the head 1, the tip 120*f* of the tapered wall 120*c* first contacts the orifice surface 1*a*. As the cap 120 is further moved toward the orifices surface 1*a*, the spring 122 is further compressed by the reactive force in the direction shown by arrow G, exerted on the tapered wall 120*c* from the orifice surface 1*a*. Thus, the cap 120 tilts in the opposite direction causing both the tapered wall 120*c* and the wall 120*a* to simultaneously abut the orifice surface 1*a* as shown in FIG. 8. In FIG. 8, both the tapered wall 120*c* and wall 120*a* are in contact with the orifice surface 1*a*, the inclined surface 120*d* making an angle $\theta_1$ with the orifice surface 1*a*. The bottom surface of the cap 120 may be formed to extend downwardly toward the hole 101*b* as was described in connection with the first embodiment, so that the ink dropped onto the bottom of the cap 120 easily flows into the pipe 102 during dummy ejection and suction. In addition to the cap 120, an additional cap similar to a cap 11 as shown in FIG. 11B, exclusively used for capping operation may be provided in the non-print area.

The rest of the construction is the same as that of the first embodiment and description thereof is omitted.

The operation of the second embodiment will now be described with reference to FIGS. 2 and 3. The suction and dummy ejection performed in steps S50–S55, part (S58–S61 and S66–S69) of the sweeping operation, and the capping operation (steps S70–S75) are the same as those of the first embodiment and therefore only operation performed in steps S62–S66 will be described as follows:

At step S62, the controller 105 drives the cap moving mechanism 114 to move the cap 120 in the direction shown by arrow F. Upon receiving at step S63 from the position sensor 107 a detection signal indicating that the tip 120*f* of the tapered wall 120*c* is in contact with the orifice surface 1*a*, the controller 105 turns off the cap moving mechanism 114 at step S64 to stop the cap 120. At this time, the flat tip 120*e* of the wall 120*a* is not in contact with the orifice surface 1*a*. Then, at step S65, the controller 105 drives the motor 112 into rotation to move the carriage 3 in the direction shown by arrow D. As the carriage 3 moves toward position H, the foreign matter and ink adhering to the orifice surface 1*a* are removed by the tip 120*f* into the cap 120.

The cap 120 of the second embodiment has a tapered wall 120*c*, and only the tip 120*f* of the tapered wall 120*c* slides on the orifice surface 1*a* when sweeping the orifice surface 1*a*. This is advantageous in that the tip 120*f* effectively sweeps the orifice surface 1*a* to collect the foreign matter and denatured ink into the cap 120, thereby ensuring reliable cleaning operation.

The compressed flat spring 122 may be replaced by, for example, a compressed coil spring which is mounted to the pipe 102 by means of a suitable mounting element to urge the cap 120 upward.

In the second embodiment, the cap 120 is adapted to tilt relative to the pipe 102 by means of a resilient member 121 inserted between the cap 120 and the pipe 102. However, the pipe, 102 may take the form of a soft, flexible pipe in which case the cap 120 is held such that the cap may be tilted relative to the orifice surface 1*a*, thus eliminating the resilient member 121.

Just as the first embodiment is applicable to a color ink jet recording apparatus as shown in FIG. 6, the second embodiment may also be applied to such a color ink jet recording apparatus.

Third embodiment

Figure 9:
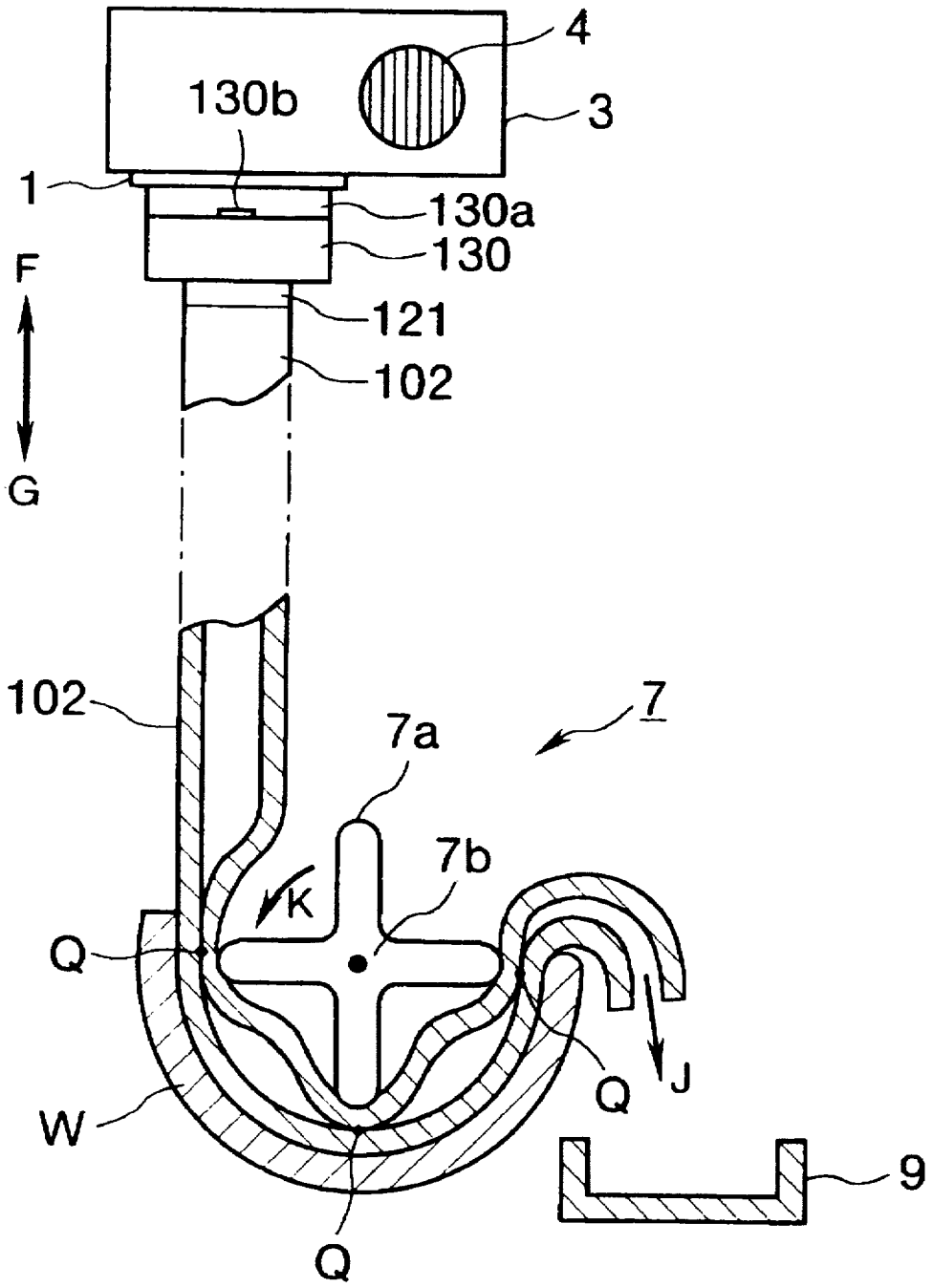
FIG. 9 illustrates a general construction of a third embodiment.
Figure 10:
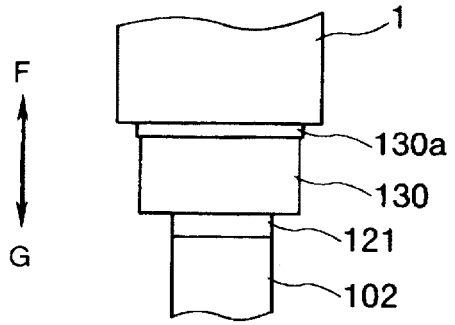
FIG. 10 illustrates the third embodiment when capping is performed.

FIG. 9 illustrates a general construction of an ink jet recording apparatus according to a third embodiment. FIG. 10 illustrates the third embodiment when the orifice surface 1*a* is capped. The third embodiment is characterized in that a cap 130 is provided with an engagement member 130*a* having a cutout 130*b* formed therein so that the cap 130 is open to the atmosphere via the cutout 130*b*. In the illustrated example, the cutout 130*b* is formed adjacent the cap 130, but the cutout 130*b* may be formed at any other part, e.g., at the upper edge of the walls of the engagement member 130*a*. However, the cutout 130*b* should not be provided at the edge which contacts the orifice surface 1*a* for sweeping operation.

Referring to FIG. 9, a carriage 3 is supported on a shaft 4 and is adapted to move along the shaft 4 in directions perpendicular to the page of FIG. 9. The cap 130 is provided with an engagement member 130*a* on its tip. The bottom surface of the cap 130 may be formed to extend downwardly toward the hole 101*b* as was described in connection with the first embodiment, so that the ink dropped onto the bottom of the cap 130 easily flows into the pipe 102 during dummy ejection and suction. The engagement member 130*a* is made of a resilient material, which is compressively deformable and is formed with the cutout 130*b* therein extending into the engagement member 130*a*. A pipe 102 is formed of a resilient material and is held by the concave circular surface of a support W. The pipe 102 has some slack between the cap 130 and the support W so that the cap 130 is movable with respect to the head 1. When the cap 130 moves in the direction shown by arrow F until the upper tip of the engagement member 130*a* just contacts the orifice surface 1*a*, the interior of the cap 130 still communicates with the atmosphere through the cutout 130*b*. As the cap 130 is pressed against the orifice surface 1*a*, the air escapes from the cap 130 through the cutout 130*b* to the atmosphere until the engagement member 130*a* is compressively deformed, as shown in FIG. 10 closing the cutout 130*b*. Thus, the cap 130 is closed, ink is prevented from drying and foreign matter is prevented from entering the cap 130.

A suction mechanism 7 used in the third embodiment is of a rotary type. A cross-shaped valve member rotates about a shaft 7*b* in a direction shown by arrow K, choking the pipe 102 at points Q when the tips 7*a* rotate to abut the pipe 102. The points Q move along the pipe 102 as the tips 7*a* rotate about the shaft 7*b*, thereby applying a negative pressure to the pipe 102, and directing the ink drops into the basin 9 as shown by arrow J. In addition to the cap 130, an additional cap similar to a cap 11 as shown in FIG. 11B, exclusively used for capping operation may be provided in the non-print area.

The cleaning and capping operations of the third embodiment are the same as those of the first embodiment except that the cap 130 is pressed against the orifice surface 1*a* until the engagement member 130*a* is compressively deformed during cleaning and capping operations.

The cutout 130*b* formed in the engagement member 130*a* serves to maintain the interior pressure of the cap 130 at the atmospheric pressure when the cap 130 is urged against the orifice surface 1*a* prior to capping and suction. The interior pressure, which is the same as the atmospheric pressure, prevents the air in the cap 130 and ink from entering the head 1 through orifices 1*c*. The compressively deformed engagement member 130*a* ensures reliable closure of the orifice surface 1*a*.

The simple cutout 130*b* in the engagement member 130*a* eliminates a need for a mechanism which is employed in some prior art recording apparatuses to release the air in the cap to the atmosphere. Thus, providing the cutout 130*b* in the engagement member 130*a* reduces the cost of the ink jet recording apparatus.

Just as the first and second embodiments are applicable to a color ink jet recording apparatus as shown in FIG. 6, the third embodiment may also be applied to such a color ink jet recording apparatus.

Fourth embodiment

Figure 11A:
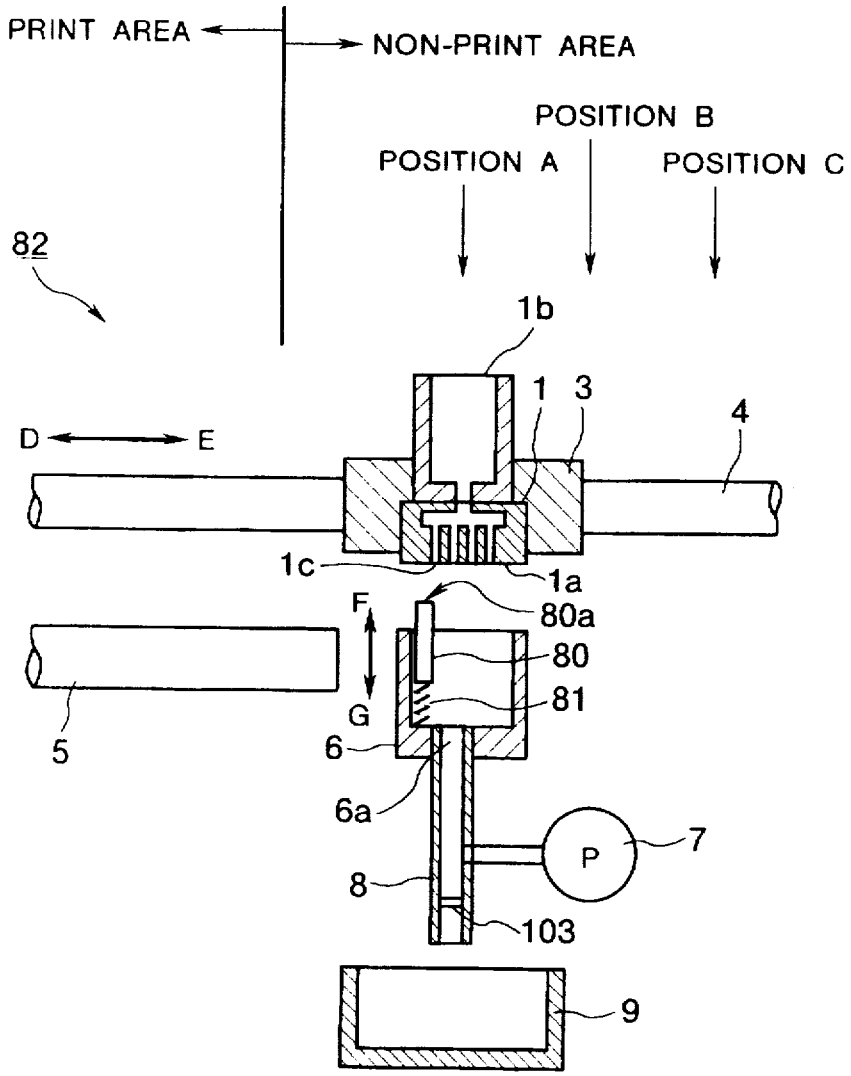
FIG. 11A illustrates a general construction of a fourth embodiment when the cap is away from the orifice surface.
Figure 11B:
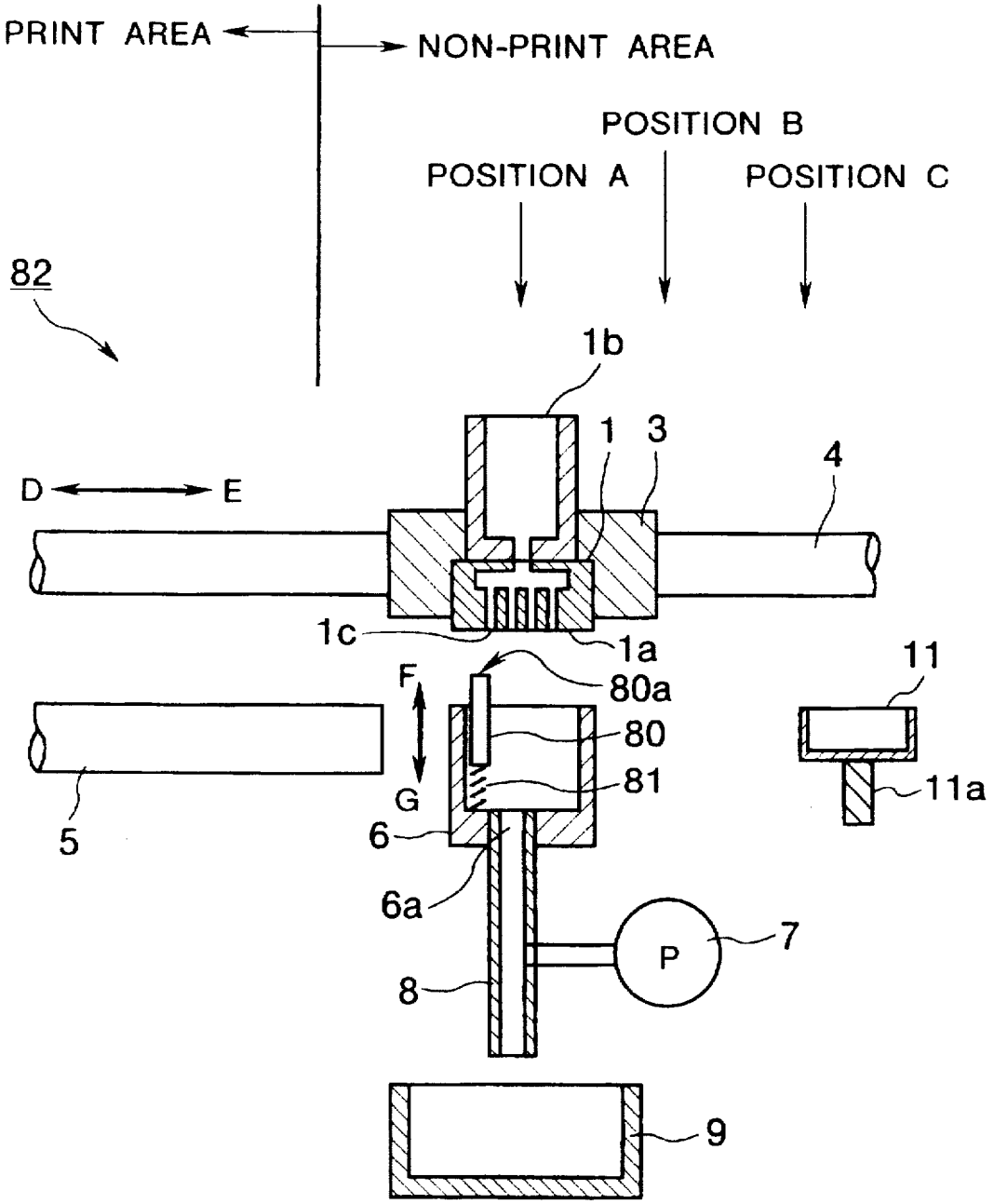
FIG. 11B illustrates a modification of the fourth embodiment in which another cap is provided.
Figure 12:
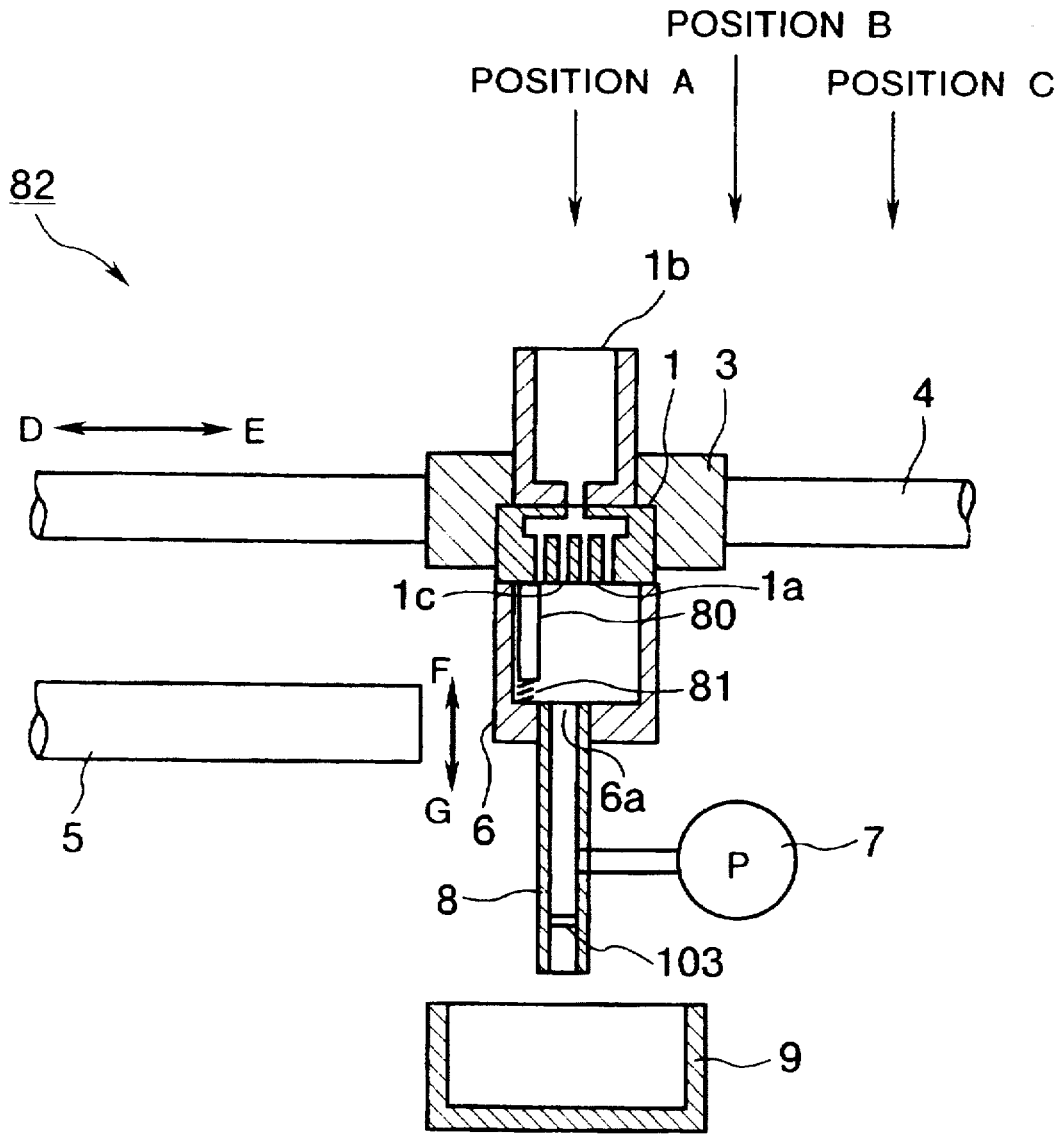
FIG. 12 illustrates the fourth embodiment when the cap is in contact with the orifice surface.

FIG. 11A illustrates a construction of a fourth embodiment. FIG. 12 illustrates a general construction of the fourth embodiment when the cap is in contact with the orifice surface. The fourth embodiment differs from the first embodiment in that the cap 6 has a sweep blade 80, which plays the same role as the engagement member 101*a*. The sweep blade 80 is disposed beside the inner surface of a wall of the cap 6, on the side located in the direction of arrow D as seen from the center of the cap 6. The sweep blade 80 is urged in a direction shown by arrow F, by a compression spring 81 which is fixedly mounted to the bottom of the cap 6. When the cap 6 is at the disengagement position, i.e., fully moved in a direction shown by arrow G, the sweep blade 80 projects toward the orifice surface 1*a* outwardly of the cap 6. When the cap 6 is moved toward the head 1, the sweep blade 80 abuts the orifice surface 1*a*. As the cap 6 is further moved toward the head 1, the sweep blade 80 is pushed back against the spring 81 so that the sweep blade 80 is completely received in the cap 6 when the cap 6 presses the orifice surface 1*a*. Thus, the sweep blade 80 does not interfere with the closing engagement of the cap 6 with the orifice surface 1*a*. When the cap 6 is moved away from the orifice surface 1*a* to the disengagement position, the sweep blade 80 regains its original position with the aid of the spring 81. Just as in the first embodiment, the pipe 8 is also provided with a solenoid valve 103. The valve is closed when capping operation is performed, thereby preventing the ink form drying due to the air entering the pipe 8. The bottom surface of the cap 6 may be formed to extend downwardly toward the hole 6*a* as was described in connection with the first embodiment, so that the ink dropped onto the bottom of the cap 6 easily flows into the pipe 8 during dummy ejection and suction.

Figure 14:
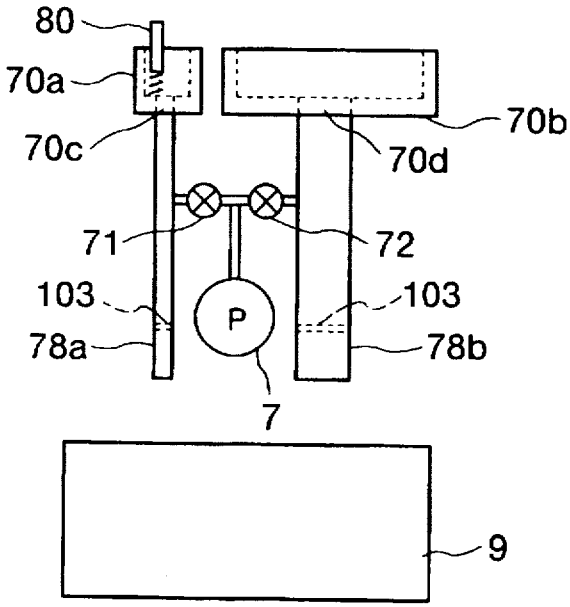
FIG. 14 illustrates another modification of the fourth embodiment, showing a sweep blade provided in the cap of FIG. 6.

The fourth embodiment is also applicable to the construction shown in FIG. 6, in which case the blade 80 may be provided in at least one cap. FIG. 14 illustrates such a modification where the blade 80 is provided in the cap 70*a* shown in FIG. 6.

The construction of the fourth embodiment eliminates a need for providing a sweep blade moving mechanism which holds and moves the sweep blade 80 in the directions shown by arrows F and G, and a motor which drives the sweep blade moving mechanism. Thus, the fourth embodiment offers the same advantages as the first embodiment at lower costs. Moreover, the ink and foreign matter removed by the sweep blade 80 are received in the cap 6 and then directed through the pipe 8 into the ink basin 9, eliminating the possibility of ink and foreign matter depositing on the outside surface of the cap 6 or within the ink jet recording apparatus 82 to cause soiling of the cap 6 and the apparatus 82. The fourth embodiment is effective in improving reliability of an ink jet recording apparatus.

In the fourth embodiment, the compression spring 81 which urges the sweep blade 80 to project from the cap 6 may be replaced by another type of spring such as a flat spring. The cap 6 may be provided with a guide, not shown, which ensures movement of the sweep blade 80 only in the directions shown by arrows F and G.

Figure 13A:
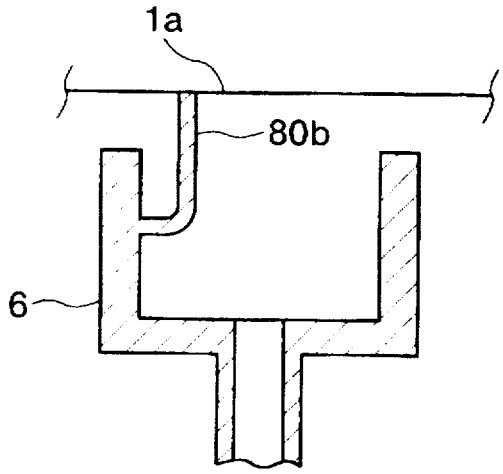
FIGS. 13A and 13B illustrate a modification of the fourth embodiment, showing a cap and a sweep blade formed in a one piece construction.
Figure 13B:
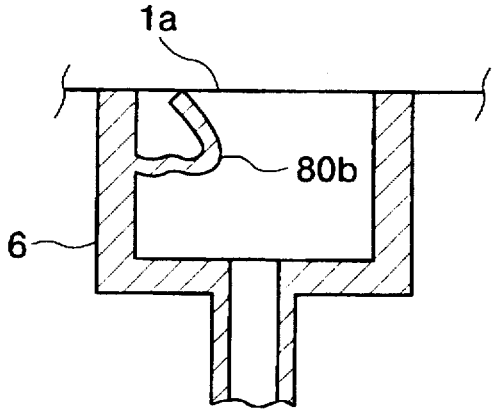

Although the sweep blade 80 is connected to the cap 6 via the compression spring 81 in the fourth embodiment, a sweep blade 80*b* and cap 6 may be formed of a resilient material such as rubber in one piece construction as shown in FIG. 13A, thereby eliminating the compression spring 81. Referring to FIG. 13A, only the tip portion of the sweep blade 80*b* projects outwardly of the cap 6 and abuts the orifice surface 1*a* during cleaning operation. The sweep blade 80*b* is pushed back by the orifice surface 1*a* into the cap 6 as shown in FIG. 13B when the cap 6 closes the orifice surface 1*a*. The cap 6 may be formed of a resilient material such as forms the engagement member 101*a* of the first embodiment, for better capping effect.

While the fourth embodiment has been described with respect to a monochrome ink jet recording apparatus 82, the embodiment is also applicable to a color ink jet recording apparatus as shown in FIG. 6.

In the first to fourth embodiments, the cumulative number of printed dots is checked to determine whether the cleaning operation or suction operation is demanded. Alternatively, the number of printed pages or the total length of time during which the head 1 is driven may be checked.

The fourth embodiment may be modified to have another cap 11 mounted to cap support 11*a* as shown in FIG. 11B. The cap 11 is used exclusively for capping operation. In the modified construction, the carriage moves to position C, after printing operation, where the orifice surface 1*a* is capped by the cap 11.

What is claimed is:

1. An ink jet recording apparatus where information is printed by ejecting ink drops through orifices formed in a surface of an ink jet head mounted on a carriage, comprising:

a cap adapted to move among a first position at which said cap is away from said orifices, a second position at which said cap closes said orifices, and a third position in which said cap is tilted with respect to said surface, said cap being tiltable with respect to said surface when said cap is away from said surface;

an engagement member formed of a resilient material and attached to a tip of said cap, said engagement member abutting said surface when said cap is at said second position, said engagement member having a wall tapered to a tip of said engagement member, said tip of said engagement member contacting said surface when said cap is at said third position;

a suction mechanism communicating with said cap, said suction mechanism negatively pressurizing said cap when said cap is at said second position; and a controller for controllably driving said carriage and said cap to move and for controllably driving said suction mechanism, said controller causing said carriage to move when said cap is at said third position so that said engagement member sweeps said surface.

2. An ink jet recording apparatus that prints information by ejecting ink drops, comprising:

a carriage;

an ink jet head mounted on the carriage, the ink jet head having a surface with orifices through which the ink drops are elected;

a cap, movable between a first position at which the cap is away from the orifices and a second position at which the cap closes the orifices;

a suction mechanism communicating with the cap, the suction mechanism negatively pressurizing the cap when the cap is at the second position;

means, including a controller and drivers, for controllably driving the carriage to move in a print area and a non-print area, controllably driving the cap to move between the first position and the second position when the carriage is in the non-print area, and performing dummy ejection of the ink drops through the orifices while simultaneously driving the suction mechanism to apply negative pressure to the orifices; and an engagement member, formed of a resilient material, attached to a tip of said cap, the engagement member abutting the surface when the cap is at the second position, the controller causing the carriage to move when the cap is at the second position so that the engagement member sweeps the surface, and wherein said engagement member has a wall formed with a hole therein, said can communicates directly with atmosphere through the hole when said cap is moved into contact with said surface, and said engagement member is resiliently compressively deformed to close said hole when said cap is pressed against said surface.

3. An ink jet recording apparatus that prints information by ejecting ink drops, comprising:

a carriage;

an ink jet head mounted on the carriage, the ink jet head having a surface with orifices through which the ink drops are elected;

a cap, movable between a first position at which the cap is away from the orifices and a second position at which the cap closes the orifices, wherein said cap is adapted to tilt with respect to said surface when said cap is away from said surface;

a suction mechanism communicating with the cap, the suction mechanism negatively pressurizing the cap when the cap is at the second position;

means, including a controller and drivers, for controllably driving the carriage to move in a print area and a non-print area, controllably driving the cap to move between the first position and the second position when the carriage is in the non-print area, and performing dummy ejection of the ink drops through the orifices while simultaneously driving the suction mechanism to apply negative pressure to the orifices; and an engagement member attached to the cap, the engagement member abutting the surface when the cap is at the second position, the controller causing the carriage to move when the can is at the second position so that the engagement member sweeps the surface;

wherein said engagement member is formed of a resilient material attached to a tip of said cap, has a hole therein through which air is released to the atmosphere when said cap is away from said surface, is resiliently deformed to close said hole when said cap is pressed against said surface, and has a wall tapered toward a tip of said engagement member, said cap can also assume a third position at which said tip of said wall is in contact with said surface with said cap tilting, and said controller causes said carriage to move when said cap is at said third position so that said engagement member sweeps said surface.

4. An ink jet recording apparatus that prints information by ejecting ink drops, comprising:

a carriage;

an ink jet head mounted on the carriage, the ink jet head having a surface with orifices through which the ink drops are ejected;

a cap, movable between a first position at which the cap is away from the orifices and a second position at which the cap closes the orifices;

a suction mechanism communicating with the cap, the suction mechanism negatively pressurizing the cap when the cap is at the second position;

means, including a controller and drivers, for controllably driving the carriage to move in a print area and a non-print area, controllably driving the cap to move between the first position and the second position when the carriage is in the non-print area, and performing dummy election of the ink drops through the orifices while simultaneously driving the suction mechanism to apply negative pressure to the orifices; and a sweep blade mounted in said cap, said sweep blade being adapted to project from said cap toward said surface when said cap is away from said surface and to retract into said cap only in a direction that is perpendicular to said surface when said cap is pressed against said surface.

5. The ink jet recording apparatus according to claim 4, wherein said cap is entirely made of a resilient material and said sweep blade is formed in one piece construction with said cap.

6. An ink jet recording apparatus that prints information by ejecting ink drops, comprising:

a carriage;

an ink net head mounted on the carriage, the ink jet head having a surface with orifices through which the ink drops are ejected;

a cap, movable between a first position at which the cap is away from the orifices and a second position at which the cap closes the orifices;

a suction mechanism communicating with the cap, the suction mechanism negatively pressurizing the cap when the cap is at the second position;

means, including a controller and drivers, for controllably driving the carriage to move in a print area and a non-print area, controllably driving the cap to move between the first position and the second position when the carriage is in the non-print area, and performing dummy ejection of the ink drops through the orifices while simultaneously driving the suction mechanism to apply negative pressure to the orifices;

a sweep blade mounted in said cap, said sweep blade being adapted to project from said cap toward said surface when said cap is away from said surface and to retract into said cap when said cap is pressed against said surface; and a spring which is mounted in said cap and urges said sweep blade to project outwardly of said cap.

7. An ink jet recording apparatus by which information is printed by ejecting ink drops through orifices formed in a surface of an ink jet head mounted on a carriage, comprising:

a cap adapted to move among a first position at which said cap is away from said orifices, a second position at which said cap closes said orifices, and a third position in which said cap is tilted with respect to said surface, said cap being tiltable with respect to said surface when said cap is away from said surface;

an engagement member formed of a resilient material and attached to a tip of said cap, said engagement member abutting said surface when said cap is at said second position;

a suction mechanism communicating with said cap, said suction mechanism negatively pressurizing said cap when said cap is at said second position; and a controller for controllably driving said carriage and said cap to move and for controllably driving said suction mechanism, said controller causing said carriage to move when said cap is at said third position so that said engagement member sweeps said surface.

8. The ink jet recording apparatus according to claim 7, wherein said controller includes a counter for counting the number of dots printed by said ink jet head, and said controller causes said engagement member to move into contact with said surface and said carriage to move in a direction parallel to said surface when said counter counts up to a predetermined value, whereby said engagement member sweeps said surface.

9. The ink jet recording apparatus according to claim 7, further including a plurality of caps, a plurality of ink jet heads, and a selector mechanism for selectively allowing said caps to communicate with said suction mechanism, wherein said controller selectively operates said selector mechanism to negatively pressurize said caps.

10. The ink jet recording apparatus according to claim 7, further including a pipe through which said cap communicates with said suction mechanism, wherein said pipe opens to an ink basin which receives ink drops from said cap.

11. The ink jet recording apparatus according to claim 10, further including a valve which closes said pipe when capping operation is performed.

12. The ink jet recording apparatus according to claim 7, further including an additional cap exclusively used for capping operation.

13. An ink jet recording apparatus by which information is printed by ejecting ink drops through orifices formed in a surface of an ink jet head mounted on a carriage, comprising:

a cap adapted to move between a first position at which the cap is away from the orifices, and a second position at which the cap closes the orifices;

a mounting member and a sweep blade, the mounting member elastically mounting the sweep blade in the cap to elastically urge the sweep blade outwardly of the cap so that the sweep blade projects from the cap toward the surface in only a single direction when the cap is away from the surface and to elastically retract into the cap, in only a linear direction opposite to the single direction, when the cap is pressed against the surface, the sweep blade abutting the surface when the cap is at the second position;

a suction mechanism communicating with the cap, the suction mechanism negatively pressurizing the cap when the cap is at the second position; and a controller for controllably driving the carriage and the cap to move and for controllably driving the suction mechanism, the controller causing the carriage to move when the cap is at the second position so that the sweep blade sweeps the surface.

14. An ink jet recording apparatus according to claim 13, further comprising means, extending through print and non-print areas, for supporting the ink jet head for movement between the print area and the non-print area.

15. An ink jet recording apparatus by which information is printed by ejecting ink drops through orifices formed in a surface of an ink jet head mounted on a carriage, comprising:

a cap adapted to move between a first position at which the cap is away from the orifices, and a second position at which the cap closes the orifices;

a spring and a sweep blade, the spring elastically mounting the sweep blade in the cap to elastically urge the sweep blade outwardly of the cap so that the sweep blade projects from the cap toward the surface when the cap is away from the surface and to elastically retract into the cap when the cap is pressed against the surface, the sweep blade abutting the surface when the cap is at the second position;

a suction mechanism communicating with the cap, the suction mechanism negatively pressurizing the cap when the cap is at the second position; and a controller for controllably driving the carriage and the cap to move and for controllably driving the suction mechanism, the controller causing the carriage to move when the cap is at the second position so that the sweep blade sweeps the surface.

16. An ink jet recording apparatus by which information is printed by ejecting ink drops through orifices formed in a surface of an ink jet head mounted on a carriage, comprising:

a cap adapted to move between a first position at which the cap is away from the orifices, and a second position at which the cap closes the orifices, wherein the cap is formed entirely as a single piece of a resilient material that includes a sweep blade disposed so as to project toward the surface when the cap is away from the surface and to compress away from the surface when the cap is pressed against the surface, the sweep blade abutting the surface when the cap is at the second position;

a suction mechanism communicating with the cap, the suction mechanism negatively pressurizing the cap when the cap is at the second position; and a controller for controllably driving the carriage and the cap to move and for controllably driving the suction mechanism, the controller causing the carriage to move when the cap is at the second position so that the sweep blade sweeps the surface.

* * * * *